US006439182B1

(12) United States Patent
Sugiura et al.

(10) Patent No.: US 6,439,182 B1
(45) Date of Patent: Aug. 27, 2002

(54) VALVE TIMING ADJUSTING DEVICE HAVING STOPPER PISTON

(75) Inventors: Taei Sugiura, Anjo; Tomomasa Oonishi, Kariya, both of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/964,507

(22) Filed: Sep. 28, 2001

(30) Foreign Application Priority Data

Oct. 6, 2000 (JP) ..... 2000-308123
Jun. 7, 2001 (JP) ..... 2001-172450

(51) Int. Cl.[7] ..... F01L 1/34
(52) U.S. Cl. ..... 123/90.17
(58) Field of Search ..... 123/90.15, 90.17, 123/90.31

(56) References Cited

U.S. PATENT DOCUMENTS 5,823,152 A 10/1998 Ushida ..... 123/90.17
5,832,887 A * 11/1998 Adachi et al. ..... 123/90.17
5,845,615 A * 12/1998 Nakamura et al. ..... 123/90.17
6,006,708 A * 12/1999 Ken et al. ..... 123/90.17
6,014,952 A * 1/2000 Sato et al. ..... 123/90.17
6,173,687 B1 * 1/2001 Fukuhara et al. ..... 123/90.17
6,302,072 B1 * 10/2001 Sekiya et al. ..... 123/90.17
6,332,439 B2 * 12/2001 Sekiya et al. ..... 123/90.17

FOREIGN PATENT DOCUMENTS

JP 1-92504 4/1989

* cited by examiner

*Primary Examiner*—Weilun Lo
(74) *Attorney, Agent, or Firm*—Nixon & Vanderhye P.C.

(57) ABSTRACT

A restraining hole for restraining a stopper piston is constituted by a straight hole having an axis perpendicular to the direction of a relative rotation of a vane rotor with respect to a shoe housing and a tapered hole formed on a deep side of the straight hole and reduced in diameter on a deep side thereof. According to this construction, by virtue of a wedge effect between the tapered hole and the stopper piston, a relative rotation between a driving shaft system and a driven shaft system can be restrained at a predetermined angular position and it is possible to suppress the occurrence of a striking sound.

12 Claims, 7 Drawing Sheets

VALVE TIMING ADJUSTING DEVICE HAVING STOPPER PISTON

CROSS REFERENCE TO RELATED APPLICATION

This application is based on and incorporates herein by reference Japanese Patent Application Nos. 2000-308123 filed on Oct. 6, 2000, and 2001-172450 filed on Jun. 7, 2001.

BACKGROUND OF THE INVENTION

1. Field of the Invention

The present invention relates to a valve timing adjusting device for changing a valve timing of at least one of an intake valve and an exhaust valve in an internal combustion engine.

2. Description of the Prior Art

Conventionally, there has been known a vane type valve timing adjusting device in which a camshaft is driven through a timing pulley or a chain sprocket adapted to rotate synchronously with a crankshaft of an engine and the valve timing of one of an intake valve and an exhaust valve is controlled hydraulically in accordance with a phase difference based on a relative rotation between the timing pulley or the chain sprocket and the camshaft.

JP-A-1-92504 discloses a valve timing adjusting device in which a relative rotation between a driving shaft system such as a timing pulley or a chain sprocket and a driven shaft system such as a camshaft is restrained when both systems are each in a predetermined relative rotational position. According to the valve timing adjusting device disclosed in JP-A-1-92504, when a vane in the driven shaft system is in a predetermined relative rotational position with respect to a rotor in the drive shaft system, a knock pin provided on the vane side is allowed to enter one of two holes formed in the rotor to restrain a relative rotation between the rotor and the vane. However, in the valve timing adjusting device, if an appropriate clearance is not present between each of the two holes formed in the rotor and the knock pin, the knock pin will be unable to fit in the holes or a striking sound may occur upon fitting of the two. There also is the problem that the clearance between one of the holes and the knock pin may become larger little by little due to a friction between the hole and the knock pin.

U.S. Pat. No. 5,23,152 discloses a valve timing adjusting device to solve the problem. According to the device disclosed therein, a fitting portion between a stopper piston corresponding to the above knock pin and a stopper hole is formed as a tapered portion to ensure a strong restraining force induced by the resulting wedge effect. The occurrence of a striking sound upon fitting of the stopper piston and the stopper hole is prevented, and a change of a relative rotation restraining position which is attributable to a change or variations in the clearance between the stopper piston and the stopper hole is prevented.

However, according to the device disclosed in the U.S. Pat. No. 5,823,152, a vane provided with the stopper piston and a housing provided with the stopper hole are restrained by abutment of slant faces not perpendicular to a direction in which the vane rotates relatively with respect to the housing. Thus, the stopper piston may slip off the stopper hole, thereby making it impossible to restrain a relative rotation between a timing pulley or a chain sprocket and a camshaft, if a large disturbance factor acts on a contact portion between the stopper piston and a wall surface of the stopper hole or if a frictional coefficient of the contact portion becomes extremely small.

SUMMARY OF THE INVENTION

An object of the present invention to provide a valve timing adjusting device capable of restraining a relative rotation between a driving shaft system and a driven shaft system at a predetermined angular position, and capable of suppressing the occurrence of a striking sound at the time of restraining the relative rotation between both systems.

According to a first aspect of the present invention, a hole for retaining a restraining pin is formed by a straight hole having an axis perpendicular to the direction of a relative rotation of a vane member with respect to a housing member, and a tapered hole which is formed on a deep side of the straight hole and which is reduced in diameter on a deep side thereof.

With a wedge effect induced by the tapered hole and the restraining pin, it is possible to restrain a relative rotation between the driving shaft system and the driven shaft system at a predetermined angular position and suppress the occurrence of a striking noise. Even if the restraining pin is retreated from the tapered hole under the influence of a disturbance or a lowering of the frictional coefficient, the restraining pin can be retained in straight hole with a vertical drag exerted by a wall surface of the straight hole on an outer wall surface of the restraining pin, so that a relative rotation between the driving shaft system and the driven shaft system can be restrained in a predetermined angular range.

According to a second aspect of the present invention, a restraining pin, which is advanced into a straight hole having an axis perpendicular to the direction of a relative rotation of a vane member with respect to a housing member, is formed with a first cylindrical portion and a second cylindrical portion different in thickness from each other. A relative rotation of the vane member with respect to the housing member is sure to be restrained in stages. More specifically, a relative rotation of the vane member with respect to the housing member is restrained in a predetermined angular range by advancing the first cylindrical portion smaller in diameter than the second cylindrical portion into the straight hole. Thus, while the vane member rotates relatively with respect to the housing member in the angular range due to a change in load imposed on the driven shaft, the second cylindrical portion larger in diameter than the first cylindrical portion can be easily advanced into the straight hole. Therefore, as the first stage, a phase difference in a predetermined range can surely be set between the driving system and the driven system in a somewhat allowed state of the relative rotation of the vane member with respect to the housing member. As the second stage, a target phase difference can be set between the driving system and the driven system, and it is also possible to set small a clearance between the second cylindrical portion and the straight hole to suppress the occurrence of a striking sound. Moreover, even in the event a large disturbance factor acts on the contact portion between the restraining pin and the straight hole wall surface or even if the frictional coefficient of the contact portion is extremely small, a phase difference can be controlled because the restraining pin is retained in the straight hole with a drag which the straight hole wall surface exerts on the first and second cylindrical portions.

According to a third aspect of the present invention, a restraining pin, which is advanced into a hole having an axis perpendicular to the direction of a relative rotation of a vane member with respect to a housing member, is formed with a front end portion and a base end portion different in thickness from each other. A stepped outer wall surface is formed by outer walls of the front end portion and the base end portion, whereby the relative rotation of the vane member with respect to the housing member is sure to be restrained. More specifically, a relative rotation of the vane member with respect to the housing member is restrained in a predetermined angular range by advancing the front end portion smaller in diameter than the base end portion into the hole, then while the vane member rotates relatively with respect to the housing member in the angular range due to a change in load imposed on the driven shaft, the base end portion larger in diameter than the front end portion can be easily advanced into the hole. Therefore, as the first stage, a phase difference in a predetermined range can surely be set between the driving system and the driven system in a somewhat allowed state of the relative rotation of the vane member with respect to the housing member. As the second stage, a target phase difference can be set between the driving system and the driven system and it is also possible to set small a clearance between the base end portion and the hole to suppress the occurrence of a striking sound. Besides, by utilizing the difference in diameter, the clearance between the front end portion of the pin and the hole can be set large to permit easy advance of the front end portion into the hole. Moreover, since a stepped portion is provided between the front end portion and the base end portion of the restraining pin, the depth of insertion of the restraining pin into the hole at the time of restraining the relative rotation of the vane member with respective to the housing member in the predetermined angular range and the depth of insertion of the restraining pin into the hole at the time of restraining the relative rotation of the vane member with respect to the housing member to a predetermined angular position are difficult to be changed by variations in manufacture.

BRIEF DESCRIPTION OF THE DRAWINGS

Additional objects and advantages of the present invention will be more readily apparent from the following detailed description of preferred embodiments thereof when taken together with the accompanying drawings in which.

DETAILED DESCRIPTION OF PREFERRED EMBODIMENTS

Hereinafter, embodiments of the present invention will be described with reference to the accompanying drawings. Although the following description will be directed mainly to a valve timing adjusting device for an exhaust valve, the present invention is also applicable to a valve timing adjusting device for an intake valve.

First Embodiment

Figure 1:
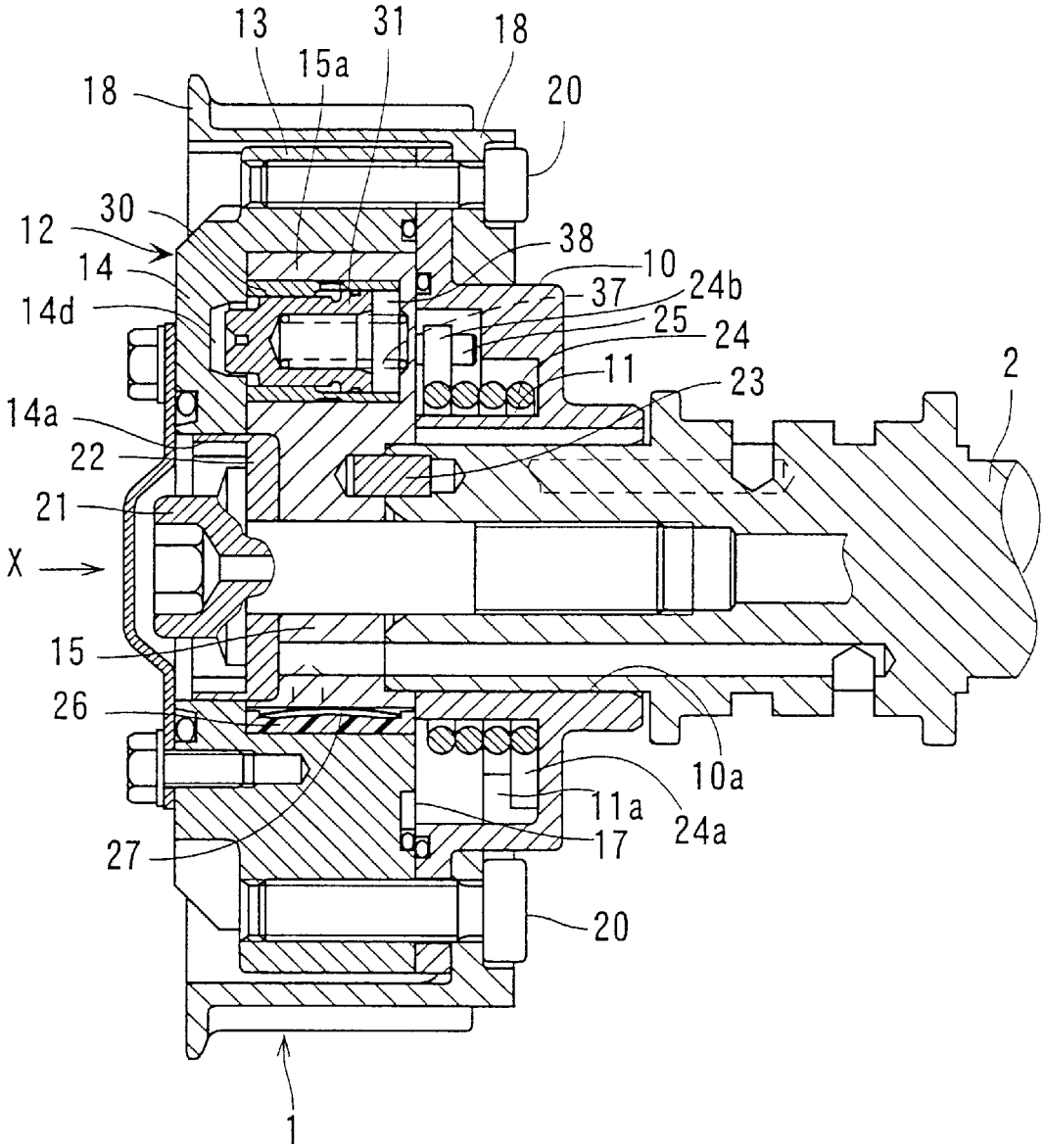
FIG. 1 is a cross-sectional view showing a valve timing adjusting device (first embodiment)

FIG. 1 shows a valve timing adjusting device 1 for an engine in the first embodiment. The valve timing adjusting device 1 is a hydraulic control type which controls the valve timing of an exhaust valve.

A housing cover 10, which is one sidewall of a housing member, is coupled with a pulley 18 by bolts 20. The pulley 18 is adapted to rotate in synchronism with a crankshaft as a driving shaft of an engine (not illustrated). A camshaft 2 as a driven shaft is supplied with a driving force from the pulley 18 and actuates an intake valve (not illustrated) in opening and closing directions. The camshaft 2 is rotatable with a predetermined phase difference with respect to the pulley 18.

The housing cover 10 and the camshaft 2 rotate clockwise when they are viewed in arrow X direction in FIG. 1. It is defined herein that this rotational direction is an advance direction.

An intermediate plate 17 formed as a thin plate is interposed between the housing cover 10 and a shoe housing 12 as well as a vane rotor 15 to prevent the leakage of oil from therebetween. The housing cover 10, the shoe housing 12, and the intermediate plate 17 form a housing member as a driving-side rotor and are coaxially fixed by bolts 20.

Figure 2:
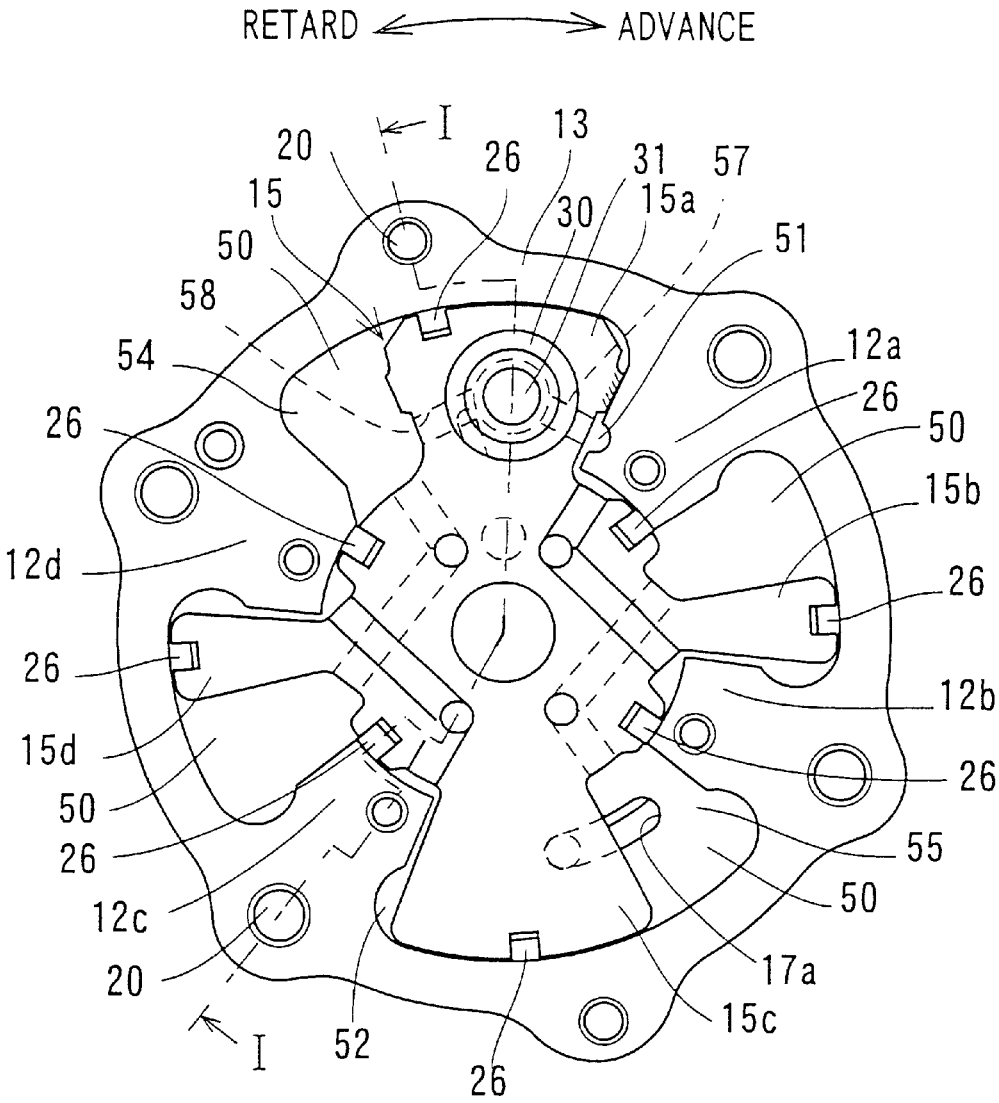
FIG. 2 is a plan view showing a vane rotor and a shoe housing (first embodiment)

The shoe housing 12 includes a circumferential wall 13 and a front plate 14 as the other side wall of the housing member and is formed in an integral or separate manner. As shown in FIG. 2, the shoe housing 12 has shoes 12*a*, 12*b*, 12*c*, and 12*d* which are formed each in trapezoidal shape at approximately equal intervals in the circumferential direction. Sectorial receptacle chambers 50 for installing vanes 15*a*, 15*b*, 15*c*, and 15*d* as vane members therein are formed respectively in four spaces which are defined in the circumferential direction by the shoes 12*a*, 12*b*, 12*c*, and 12*d*. Inner peripheral surfaces of the shoes 12*a*, 12*b*, 12*c*, and 12*d* are formed in an arc in cross-section.

As shown in FIG. 2, the vane rotor 15 as a vane member has the vanes 15*a*, 15*b*, 15*c*, and 15*d* at approximately equal intervals in the circumferential direction. The vanes 15*a*, 15*b*, 15*c*, 15*d* are accommodated respectively within the receptacle chambers 50 rotatably. Each vane 15*a*–15*d* divides the associated receptacle chamber 50 into a retard oil chamber and an advance oil chamber.

The arrows indicating a retard direction and an advance direction in FIG. 2 represent retard and advance directions of the vane rotor 15 with respect to the shoe housing 12. As shown in FIG. 1, the vane rotor 15 and a bushing 22 are integrally fixed to the camshaft 2 by a bolt 21, and form a driven-side rotor. Positioning in the rotational direction of the vane rotor 15 with respect to the camshaft 2 is performed by a pin 23.

Figure 3A:
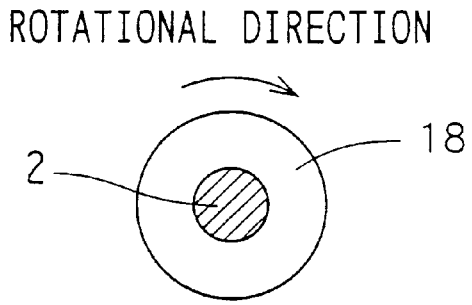
FIG. 3A is a schematic view for explaining a load torque imposed on a camshaft (first embodiment)
Figure 3B:
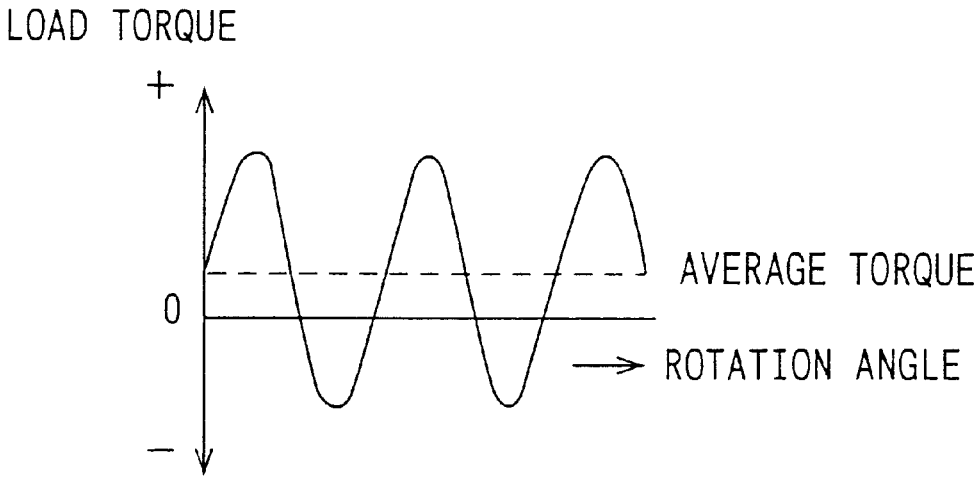
FIG. 3B is a graph for explaining a load torque imposed on a camshaft (first embodiment)

A load torque which the camshaft 2 undergoes when actuating an exhaust valve varies to both positive and negative sides, as shown in FIG. 3B. A positive-side load torque urges the vane rotor 15 to the retard side with respect to the shoe housing 12, and a negative-side load torque urges the vane rotor 15 to the advance side with respect to the shoe housing 12. An average of the load torque acts on the positive side, i.e., retard side. The biasing force of a spring 24 acts as torque for rotating the vane rotor 15 to the advance side with respect to the shoe housing 12. The torque in the advance direction exerted by the spring 24 on the vane rotor 15 is maximum when the vane rotor 15 is at the most retard position, and becomes smaller gradually as the vane rotor rotates in the advance direction.

As shown in FIG. 1, a guide ring 30 is press-fitted and held in an inner wall of the vane 15*a* including a receptacle hole 38, and a stopper piston 31 as a restraining pin is accommodated within the guide ring 30 so as to be slidable in the rotational axis direction of the camshaft 2. The guide ring 30 constitutes an element which supports the stopper piston 31 so that the stopper piston 31 can slide and reciprocate. The stopper piston 31 gets in and out of a hole 14*d* formed in the front plate 14.

Figure 4:
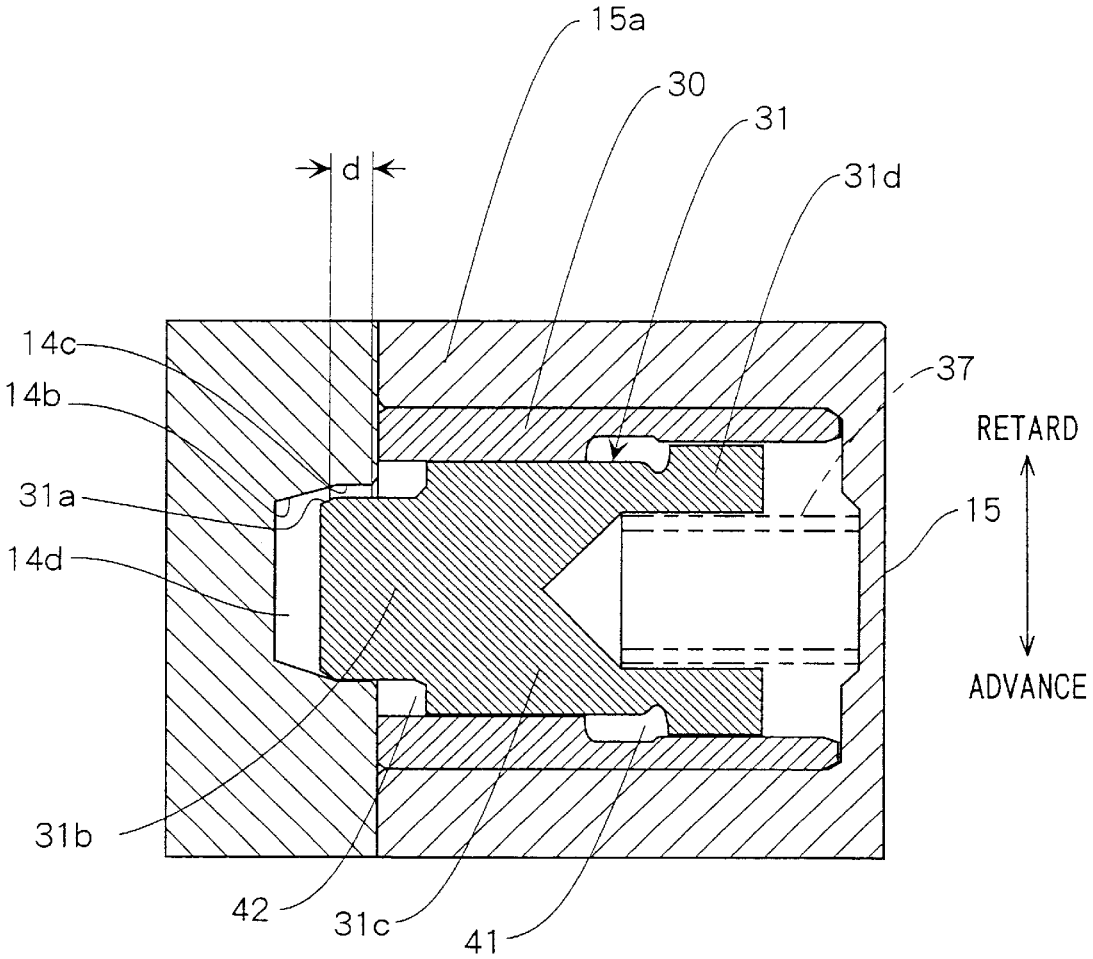
FIG. 4 is a partial cross-sectional view showing the valve timing adjusting device (first embodiment)

As shown in FIGS. 1 and 4, the stopper piston 31 is formed in the shape of a stepped column having a small-diameter portion 31*b*, a medium-diameter portion 31*c*, and a large-diameter portion 31*d* successively from the front plate 14 side. As shown in FIG. 4, the large-diameter portion 31*d* and the medium-diameter portion 31*c* are slidably supported within an inner peripheral wall of the guide ring 30.

An outside diameter of the medium-diameter portion 31*c* is larger than a maximum inside diameter of the hole 14*d*, so that the medium-diameter portion 31*b* does nor get into the hole 14*d*. An outside diameter of the small-diameter portion 31*b* is smaller than the maximum inside diameter of the hole 14*d* and larger than a minimum inside diameter of the hole 14*d*. A front end portion of the small-diameter portion 31*b* is chamfered to form a tapered surface 31*a* so that the small-diameter portion 31*b* can get into the hole 14*d* smoothly.

The hole 14*d* is formed of both a cylindrical wall surface 14*c* and a tapered wall surface 14*b* of the front plate 14. In the present embodiment the hole 14*d* is defined by wall surfaces of the front plate 14. Alternatively, a ring-like bushing may be embedded in the front plate 14 and the hole may be formed by an inner peripheral wall surface of the bushing. The cylindrical wall surface 14*c* forms a straight hole in the present invention, and the tapered wall surface 14*b* forms a tapered hole in the present invention. The straight and tapered holes formed by the cylindrical and tapered wall surfaces 14*c*, 14*b*, respectively, are coaxial with each other and the respective axes are parallel to the rotational axes of the driving- and driven-side rotors. That is, the axes of the straight and tapered holes are perpendicular to the relative rotational direction of the vane rotor 15.

Figure 5A:
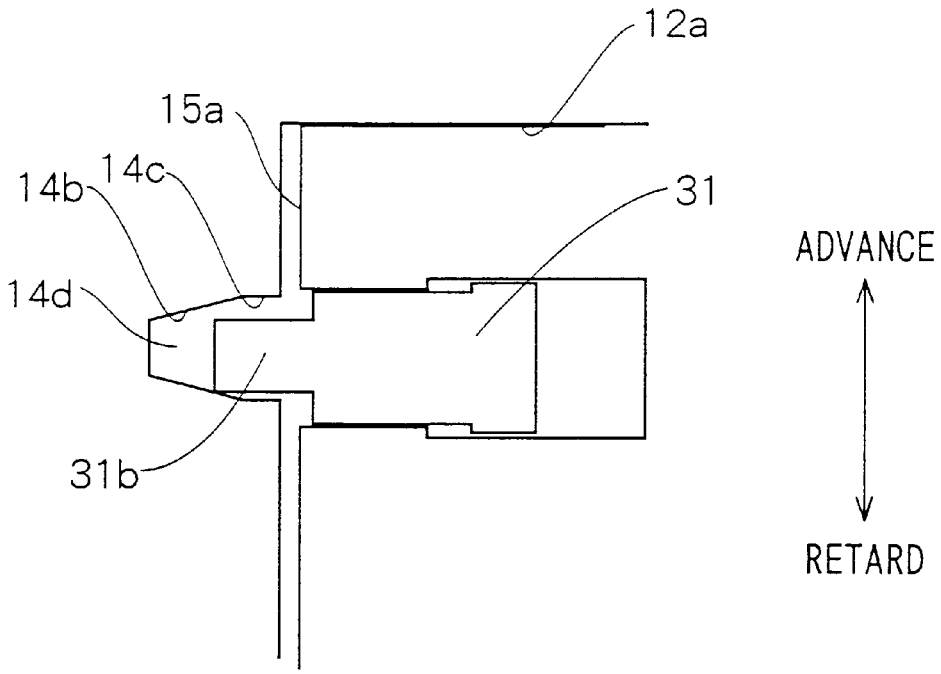
FIGS. 5A and 5B are schematic views for explaining the position of a fitting hole in the valve timing adjusting device (first embodiment)

A phase which restrains the relative rotation between the driving-side rotor and the driven-side rotor is determined by a circumferential position of the hole 14*d* in the front plate 14. In the present embodiment, for adjusting the valve timing of the exhaust valve to shorten an opening overlap period between the exhaust valve and the intake valve at the time of starting the engine, as shown in FIG. 5A, a circumferential position of the hole 14*d* is established so that an outer wall surface of the small-diameter portion 31*b* comes into abutment against the tapered wall surface 14*b* when the stopper piston 31 gets into the hole 14*d* at the most advance position where the vane 15*a* abuts the shoe 12*a*. With a wedge effect between the stopper piston 31 and the hole 14*d*, the vane rotor 15 is restrained with respect to the shoe housing 12 at the position where the vane 15*a* comes into abutment against the shoe 12*a*.

Figure 5B:
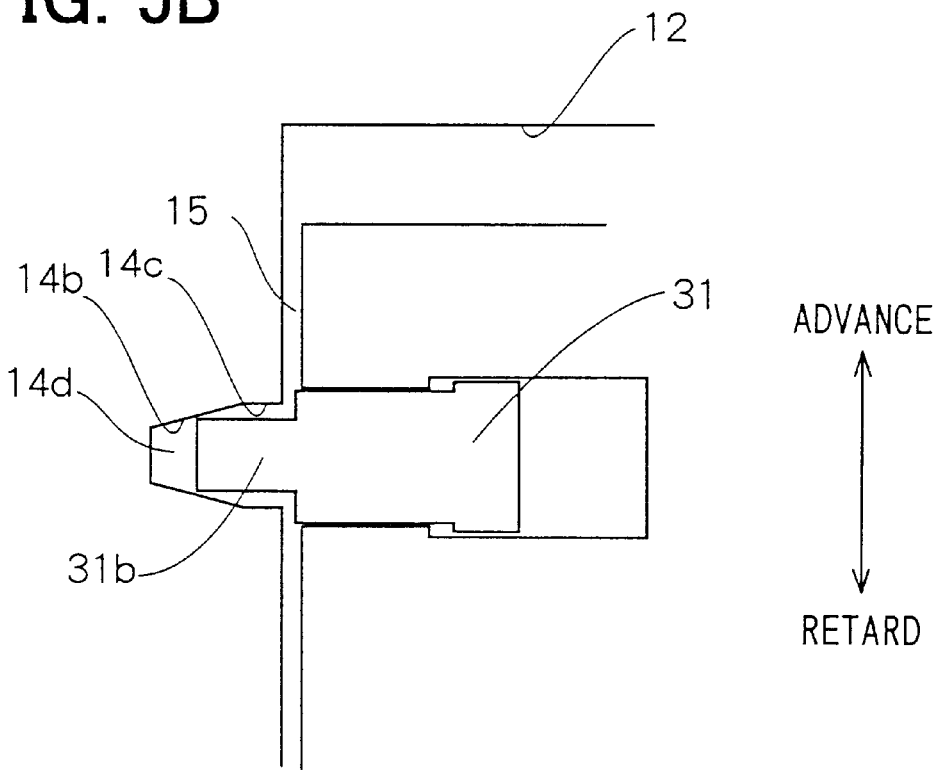

In case of adjusting the valve timing of the intake valve to shorten the opening overlap period between the exhaust and intake valves at the time of starting the engine, it suffices to set the fitting hole position at a position where the vane rotor is restrained at the most retard position. In case of adjusting the valve timing of the intake valve to restrain, after the start of the engine, the vane rotor with respect to the shoe housing on a more retard side than in starting the engine, it suffices to restrain the vane rotor with respect to the shoe housing at an intermediate position between the most advance position and the most retard position. In case of restraining the vane rotor with respect to the shoe housing at a position intermediate between the most advance position and the most retard position, as shown in FIG. 5B, the vane rotor 15 is restrained with respect to the shoe housing 12 at a position where the axis of the stopper piston 31 and that of the restraining hole 14*d* are superimposed together coaxially. At this time, the relative rotation of the vane rotor 15 is restrained by a clearance-zero fitting due to a wedge effect between the stopper piston 31 and the restraining hole 14*d*.

The length d of the cylindrical wall surface 14*c* in the depth direction of the hole 14 is preferably in the range of 0.2 mm to 10 mm, more preferably about 1.5 mm. This is because when the length d is too large, the distance of movement of the stopper piston 31 necessary for pulling out the stopper piston 31 from the hole 14*d* becomes long and it is no longer possible to quickly control the insertion and extraction of the stopper piston 31. Further, this is because when the piston moving distance is too short, the section in which the stopper piston 31 receives a vertical drag from the tapered wall surface 14*b* becomes short and it becomes easier for the stopper piston 31 to come off the hole 14*d* due to a disturbance factor.

The angle of taper of the tapered wall surface 14*b* is preferably in the range of 2° to 20°, more preferably about 15°. This is because when the taper angle is too small, a variation in the insertion depth of the stopper piston 31 caused by a positional deviation between the stopper piston 31 and the hole 14*d* becomes large. Meanwhile, when the taper angle is too large, a component force of disturbance acting in a direction to let the stopper piston 31 leave the hole 14*d* becomes large and the insertion depth of the stopper piston 31 is apt to change.

An oil chamber 42 is formed annularly by outer wall surfaces of the small-diameter portion 31*b* and medium-diameter portion 31*c* of the stopper piston 31, the cylindrical wall surface 14*c*, the tapered wall surface 14*b* and the inner peripheral wall surface of the guide ring 30. The oil chamber 42 communicates with a retard oil chamber 51 through an oil passage 57 shown in FIG. 2. An oil chamber 41 is formed annularly by the outer wall surfaces of the medium-diameter portion 31*c* and the large-diameter portion 31*d* of the stopper piston 31 and the inner peripheral wall surface of the guide ring 30. The oil chamber 41 communicates with an advance oil chamber 54 through an oil passage 58 shown in FIG. 2.

A pressure receiving area of the stopper piston 31 which receives an oil pressure from the oil chamber 42 is set so as to be larger than that of the stopper piston 31 which receives an oil pressure from the oil chamber 41. With which of the advance oil chamber 54 or the retard oil chamber 51 the oil chambers 41 and 42 are to be communicated is determined in accordance with a relation between the pressure receiving area of the stopper piston 31 which receives the oil pressure of the oil chamber 42 and that of the stopper piston which receives the oil pressure of the oil chamber 41.

The stopper piston 31 is urged toward the front plate 14 by a compression coil spring 37 of which one end is in abutment against the vane. rotor 15. The force induced by hydraulic oil in the oil chambers 41 and 42 acts in a direction to pull out the stopper piston 31 from the hole 14*d* against the biasing force of the coil spring 37.

When the force which the stopper piston 31 receives from the hydraulic oil in the hydraulic chambers 41 and 42 is larger than the biasing force of the coil spring 37 and the stopper piston 31 retreats from the hole 14*d*, allowing the vane rotor 15 to rotate from the most advance position to the retard side with respect to the shoe housing 12, there occurs a positional deviation in the circumferential direction between the stopper piston 31 and the hole 14*d*, so that the stopper piston 31 can no longer get into the hole 14*d*.

Next, the operation of the valve timing adjusting device 1 will be explained hereinafter.

Hydraulic oil is fed from a pump (not illustrated) into the retard oil chamber and the advance oil chamber, and the oil pressures in both chambers are controlled by a control valve which is controlled by an engine control unit (ECU) (not illustrated). A relative rotational position of the vane rotor 15 with respect to the shoe housing 12 depends on a balance among the oil pressures in the retard and advance oil chambers, the biasing force of the spring 24 and a load torque imposed on the camshaft 2. A feedback control is made to an appropriate position by the ECU according to operating conditions of the engine.

When the vane rotor 15 is at the most advance position with respect to the shoe housing 12 and the relative rotation of the vane rotor 15 with respect to the shoe housing 12 is to be restrained in that position, the oil pressures in the retard oil chamber 51 and the advance oil chamber 54 are controlled so as to let the stopper piston 31 move toward the front plate 14 against the pressure of the hydraulic oil. When the vane 15*a* is put in abutment against the shoe 12*a*, the vane rotor 15 is at the most advance position with respect to the shoe housing 12. Even with the vane rotor 15 located on a somewhat retard side from the most advance position, the stopper piston 31 can get into the hole 14*d* if only the inside diameter of the straight hole formed by the cylindrical wall surface 14*c* is set sufficiently larger than the outside diameter of the stopper piston 31. Besides, since the front end portion of the small-diameter portion 31*b* is chamfered, the stopper piston 31 can get into the hole 14*d* smoothly.

As shown in FIG. 4, when the stopper piston 31 advances into the hole 14*d* up to the position at which the small-diameter portion 31*b* comes into abutment against the cylindrical wall surface 14*c*, then even with a disturbance factor acting to cause the vane rotor 15 to rotate relatively with respect to the shoe housing 12, the relative rotation of the vane rotor 15 with respect to the shoe housing 12 is restrained within the range of the clearance between the cylindrical wall surface 14*c* and the small-diameter portion 31*b* by virtue of a drag which the cylindrical wall surface 14*c* perpendicular to the relative rotational direction exerts on the outer peripheral wall surface of the small-diameter portion 31*b*. Further, the cylindrical wall surface 14*c* faces the outer peripheral wall surface of the small-diameter portion 31*b* in the relative rotational direction. Even in the presence of a disturbance factor acting to rotate the vane rotor 15 relatively with respect to the shoe housing 12 or even if the coefficient of friction between the cylindrical wall surface 14*c* and the outer peripheral wall surface of the small-diameter portion 31*b* is small, the stopper piston 31 does tot get out of the hole 14*d* completely.

While the vane rotor 15 rotates relatively with respect to the shoe housing 12 within the range of clearance between the cylindrical wall surface 14*c* and the small-diameter portion 31*b* due to a change in load torque imposed on the camshaft 2, the stopper piston 31 moves gradually to the deep side of the hole 14*d* along the tapered wall surface 14*b*. Then, as shown in FIG. 5A, the relative rotation of the vane rotor 15 with respect to the shoe housing 12 is restrained completely by a wedge effect between the tapered wall surface 14*b* and the stopper piston 31. Consequently, by causing the stopper pin 31 to enter the hole 14*d*, the camshaft 2 can be rotated with an accurate phase difference with respect to the crankshaft, and it is possible to suppress a striking sound which is produced at the time of restraining the relative rotation.

When the relative rotation of the vane rotor 15 with respect to the shoe housing 12 is to be released from the restrained state to let the vane rotor 15 move to the advance side relative to the shoe housing 12, the oil pressure in either the retard oil chamber 51 or the advance oil chamber 54 is controlled to a high pressure side, causing the stopper piston 31 to retreat from the hole 14*d* under the pressure of the hydraulic oil in the oil chambers 41 and 42. At this time, the outer wall surface of the small-diameter portion 31*b* of the stopper piston 31 moves in the retreating direction from its abutted state against the tapered wall surface 14*b*, thus the stopper piston 31 does not gouge the tapered wall surface 14*b*. Likewise, when the stopper piston 31 retreats from the hole 14*d* up to a position where the front end portion of the small-diameter portion 31*b* moves reaches the straight hole, the stopper piston 31 does not gouge the cylindrical wall surface 14*c* because there is a sufficiently large clearance between the small-diameter portion 31*b* and the cylindrical wall surface 14*c*.

Second Embodiment

A valve timing adjusting device according to the second embodiment will be described. In the second embodiment, the shape of a stopper piston and that of a hole for retaining the stopper piston are modified from those in the first embodiment. In the second embodiment, the other points than the shapes of the stopper piston and the hole are the same as in the first embodiment.

Figure 6:
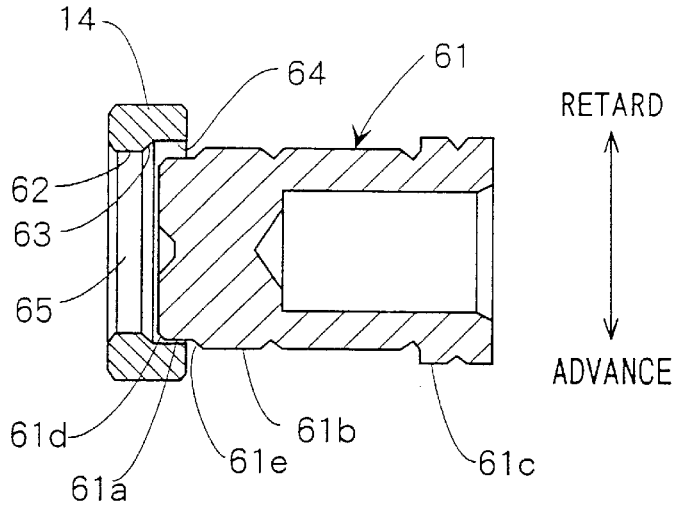
FIG. 6 is a cross-sectional view showing a stopper piston and a hole for retaining the stopper piston (second embodiment)

As shown in FIG. 6, a stopper piston 61 is formed in the shape of a stepped, bottomed cylinder having a small-diameter portion 61*a* as a first cylindrical portion, a medium-diameter portion 61*b* as a second cylindrical portion, and a large-diameter portion 61*c* successively from the front plate 14 side. A front end portion of the small-diameter portion 61*a* is chamfered and a tapered wall surface 61*d* is formed at an edge portion of the small-diameter portion 61*a*. A hole 65 which retains the stopper piston 61 is formed in the shape of a two-step straight hole by both tapered wall surface 63 and cylindrical wall surface 62. A tapered wall surface 61*e* formed between the medium-diameter portion 61*b* and the large-diameter portion 61*c* of the stopper piston 61 and the tapered wall surface 63 of the front plate 14 come into abutment against each other. The entry of the stopper piston 61 into the hole 65 is limited. The cylindrical wall surface 64 forms a straight hole in the present invention. A ring-like bushing for sliding contact with the stopper piston 61 may be embedded in the front plate 14 and a hole 65 may be formed in the bushing.

The inside diameter of the straight hole formed by the cylindrical wall surface 64 is set larger than the outside diameters of the small-diameter portion 61*a* and the medium-diameter portion 61*b*, so that the stopper piston 61 can get into the hole 65 up to the position of abutment between the tapered wall surfaces 63 and 61*e*. When the stopper piston 61 has reached the deepest portion of the hole 65, a very small clearance is formed between the cylindrical wall surface 64 and the outer wall of the medium-diameter portion 61*b*. The inside diameter of the straight hole formed by the cylindrical wall surface 62 is larger than the outside diameter of the small-diameter portion 61*a*. In the present embodiment, the tapered wall surfaces 61*d* and 63 are formed on the stopper piston 61 side and the front plate 14 side, respectively, thereby allowing the stopper piston 61 to get into the deep side of the hole 65 smoothly.

Third Embodiment

Figure 7:
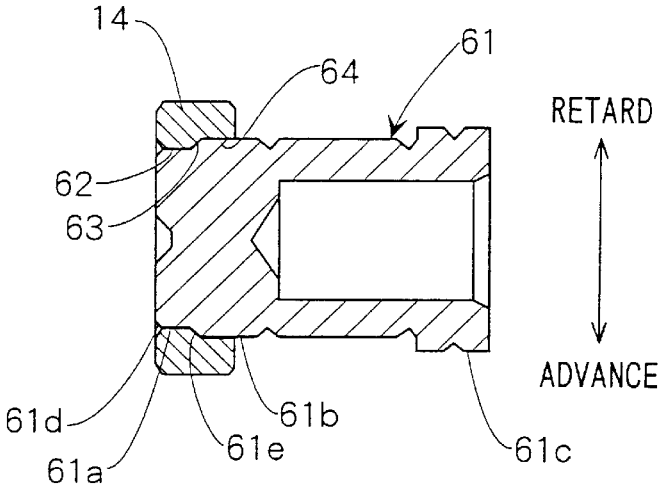
FIG. 7 is a cross-sectional view showing the stopper piston and the hole for retaining the stopper piston (second embodiment)
Figure 8:
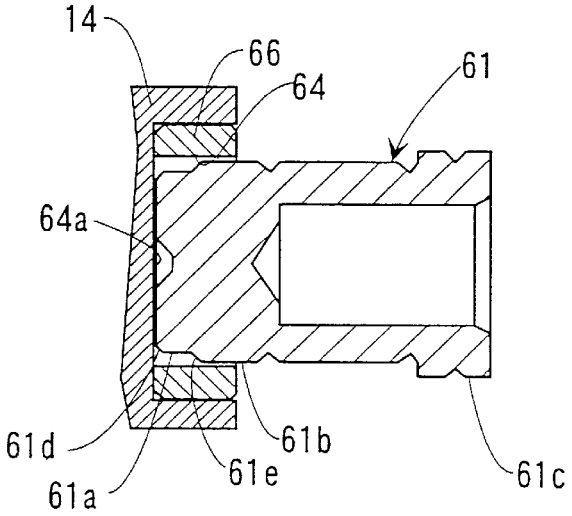
FIG. 8 is a cross-sectional view showing a stopper piston and a hole for retaining the stopper piston (third embodiment)

In the second embodiment shown in FIGS. 6 and 7, an insertion depth of the stopper piston 61 is determined by abutment of two tapered wall surfaces. However, there may be adopted such a modification as shown in FIG. 8, wherein a cylindrical wall surface 64 free of any stepped portion is formed as a wall surface which defines a hole for retaining the stopper piston 61, and an insertion depth of the stopper piston 61 is determined by abutment between a bottom surface 64*a* of the hole and a front end face of the stopper piston 61. In this case, since the bottom surface 64*a* of the hole and the front end face of the stopper piston 61 can be abutted over a wide area, a strong resistance can be ensured against wear and deformation, and it is possible to suppress a secular change in insertion depth of the stopper piston 61 caused by wear. Besides, the inner wall of the hole can be formed in a simple shape easy to undergo machining.

Fourth Embodiment

Figure 9:
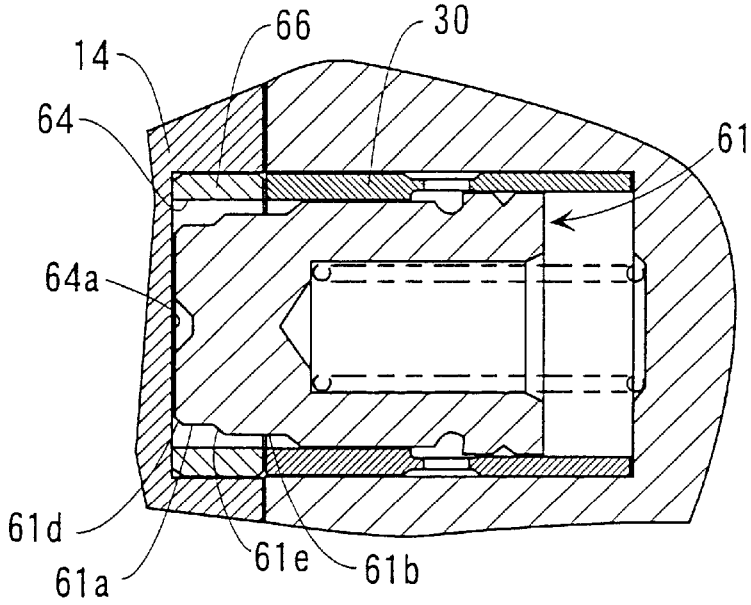
FIG. 9 is a cross-sectional view showing a stopper piston and a hole for retaining the stopper piston (fourth embodiment)

Further, as shown in FIG. 9, the outside diameter of the stopper piston 61 may be set smaller at its portion entering the hole than at its portion which slides the guide ring 30, so that, even if an outer wall of the medium-diameter portion 61*b* is pressed and deformed by the cylindrical wall surface 64, this may not exert any influence on the sliding motion of the stopper piston 61 with respect to the guide ring 30.

When the vane rotor 15 is near the most advance position with respect to the shoe housing 12 and a resultant force of the biasing force of the compression coil spring 37 and the force induced by the pressure of the hydraulic oil urges the stopper piston 61 toward the front plate 14, the stopper piston 61 can get into the hole 65 easily because the inside diameter of the straight hole formed by the cylindrical wall surface 64 is sufficiently larger than the outside diameter of the small-diameter portion 61*a*. Besides, since the front end portion of the small-diameter portion 61*a* is chamfered, the stopper piston 61 gets into the hole 65 smoothly. When the stopper piston 61 advances into the hole 65 up to the position where the outer peripheral wall of the small-diameter portion 61*a* and the cylindrical wall surface 64 come into abutment against each other, even if a force for relative rotation of the vane rotor 15 with respect to the shoe housing 12 acts on the vane rotor 15, the relative rotation of the vane rotor 15 with respect to the shoe housing 12 is restrained within the range of a clearance between the cylindrical wall surface 64 and the small-diameter portion 61*a* by virtue of a resisting force which the cylindrical wall surface 64 perpendicular to the relative rotational direction exerts on the outer peripheral surface of the small-diameter portion 61*a* also perpendicular to the relative rotational direction. Further, the cylindrical wall surface 64 and the outer peripheral wall surface of the small-diameter portion 61*a* face each other in the relative rotational direction. Therefore, even in the presence of a disturbance factor acting to rotate the vane rotor 15 with respect to the shoe housing 12 or even if the coefficient of friction between the cylindrical wall surface 64 and the outer peripheral wall surface of the small-diameter portion 61*a* is small, it is not likely at all that the stopper piston 61 will leave the hole 65 completely.

While the vane rotor 15 rotates relatively within the range of the clearance between the cylindrical wall surface 64 and the small-diameter portion 61*a* due to a change in the load torque imposed on the camshaft 2, the stopper piston 61 moves to the deep side in the hole 65 along the tapered wall surface 63. The relative rotation of the vane rotor 15 with respect to the shoe housing 12 is restrained almost completely at the position of abutment of the tapered wall surfaces 63 and 61*e*, that is, at the position at which the outer peripheral wall surface of the medium-diameter portion 61*b* and the cylindrical wall surface 64 face each other through a very small clearance. Therefore, by causing the stopper piston 61 to enter the hole 65 up to the deepest position, the camshaft 2 can be rotated with an accurate phase difference with respect to the camshaft. Moreover, since the clearance between the outer peripheral wall surface of the medium-diameter portion 61*b* and the cylindrical wall surface 64 is very small, it is possible to suppress a striking sound generated at the time of restraining the relative rotation of the vane rotor 15 with respect to the shoe housing 12.

Further, according to the second embodiment, the depth of insertion of the stopper piston 61 can be controlled accurately irrespective of a disturbance factor except the section where the tapered wall surfaces 63 and 61*d* are abutted against each other. This is because a disturbance factor acts in a direction to rotate the vane rotor 15 relatively with respect to the shoe housing 12, but a component of force in a direction to let the stopper piston 61 leave the hole 65 is not developed by the disturbance factor since the stopper piston 61 and the front plate 14 are abutted against each other through respective surfaces perpendicular to the relative rotational direction except the section where the tapered wall surfaces 63 and 61*d* are in abutment against each other.

Figure 10:
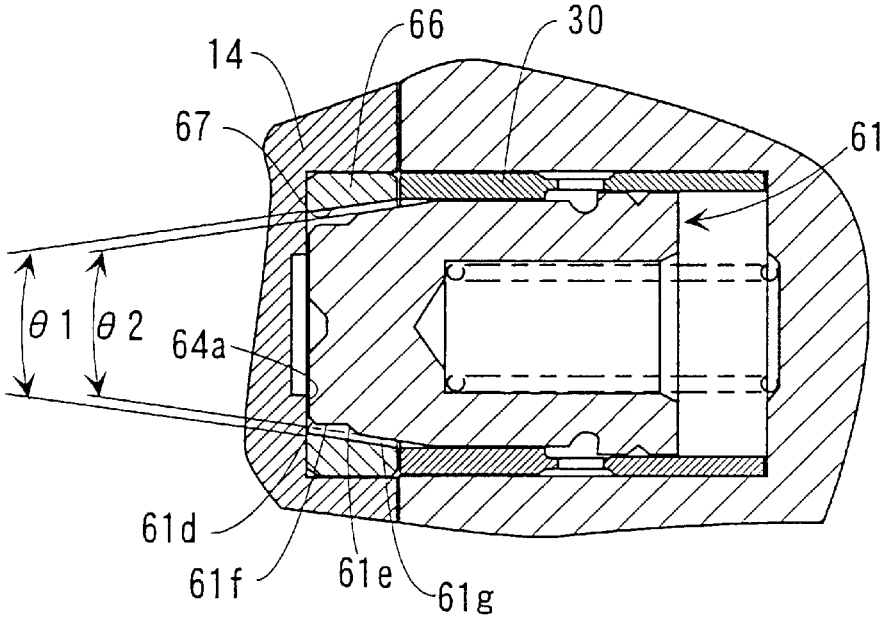
FIG. 10 is a cross-sectional view showing a stopper piston and a hole for retaining the stopper piston (Modification).

In the second through fourth embodiments, the hole for retaining the stopper piston 61 is formed as a straight hole, and the portion of the stopper piston 61 which gets into the straight hole is cylindrically formed. However, it is not always necessary to form the stopper piston 61 and the hole so as to abut each other at respective wall surfaces perpendicular to the relative rotation direction. For example, there may be adopted such a constitution as shown in FIG. 10 in which the hole for retaining the stopper piston 61 is formed as a tapered hole 67 and the stopper piston 61 is formed with a cylindrical front end portion 61*f* and a tapered base end portion 61*g*. It is preferable that taper angles θ1 and θ2 be in the range of 2° to 15°, as described above. A stepped outer wall surface is formed by outer wall surfaces of both front end portion 61*f* and base end portion 61*g*, and this stepped structure makes a remarkable difference in outside diameter between the front end portion 61*f* and the base end portion 61*g*. Thus, the depth of insertion of the stopper piston 61 into the tapered hole 67 hardly varies due to variations in manufacture. In the stepped structure, moreover, the front end portion 61*f* is considerably smaller in diameter than the base end portion 61*g*. Thus, in comparison with a stepless tapered stopper piston, the stepped stopper piston 61 can easily get into the tapered hole 67. Further, since the stepped structure allows the front end portion 61*f* to be rendered fairly small in diameter as compared with the base end portion 61*g*, the taper angles θ1 and θ2 can be set smaller than in a stepless stopper piston.

What is claimed is:

1. A valve timing adjusting device which is installed in a driving force transmitting system for transmitting a driving force from a driving shaft of an internal combustion engine to a driven shaft for opening and closing at least one of an intake valve and an exhaust valve, and adjusts the opening-closing timing of at least either one of the intake valve or the exhaust valve, said valve timing adjusting device comprising:

a housing member rotating together with said driving shaft, said housing member defining a housing chamber thereinside; and a vane member rotating together with said driven shaft, said vane member housed in said housing chamber to partition said housing chamber into a retard chamber and an advance chamber, said vane member driven to rotate by a fluid pressure with respect to said housing member within a range of predetermined angle, wherein one of said housing member and said vane member includes a straight hole, said straight hole has an axis perpendicular to a direction of relative rotation of said vane member with respect to said housing member, the other of said housing member and said vane member includes a restraining pin, said restraining pin has a first cylindrical portion and a second cylindrical portion, said first cylindrical portion is adapted to be retained by said straight hole to restrain the relative rotation of said vane member with respect to said housing member in a predetermined angular range, said second cylindrical portion is formed on a base end side of said first cylindrical portion and thicker than said first cylindrical portion, said second cylindrical portion is adapted to be retained by said straight hole to restrain the relative rotation of said vane member with respect to said housing member at a predetermined angular position, and a pin driving means is provided for driving said restraining pin into and out of said straight hole.

2. A valve timing adjusting device according to claim 1, wherein said restraining pin has a tapered portion between said first and second cylindrical portions, and a side face of said tapered portion is formed in a circular truncated cone.

3. A valve timing adjusting device according to claim 1, wherein a front end portion of said restraining pin is chamfered.

4. A valve timing adjusting device according to claim 1, wherein depth of insertion of said restraining pin into said straight hole is limited by abutment of a front end portion thereof against a bottom of said straight hole.

5. A valve timing adjusting device according to claim 1, wherein an outside diameter of said restraining pin is smaller at the second cylindrical portion than at a portion thereof which comes into sliding contact with said pin driving means.

6. A valve timing adjusting device which is installed in a driving force transmitting system for transmitting a driving force from a driving shaft of an internal combustion engine to a driven shaft for opening and closing at least one of an intake valve and an exhaust valve, and adjusts the opening-closing timing of at least either one of the intake valve or the exhaust valve, said valve timing adjusting device comprising:

a housing member rotating together with said driving shaft, said housing member defining a housing chamber thereinside; and a vane member rotating together with said driven shaft, said vane member housed in said housing chamber to partition said housing chamber into a retard chamber and an advance chamber, said vane member driven to rotate by a fluid pressure with respect to said housing member within a range of predetermined angle, wherein one of said housing member and said vane member includes a hole having an axis perpendicular to a direction of relative rotation of said vane member with respect to said housing member, the other of said housing member and said vane member includes a restraining pin, said restraining pin has a front end portion and a base end portion, said front end portion is adapted to be retained by said hole to restrain the relative rotation of said vane member with respect to said housing member in a predetermined angular range, said base end portion is formed on a base end side of said front end portion and thicker than said front end portion, said base end portion is adapted to be retained by said hole to restrain the relative rotation of said vane member with respect to said housing member at a predetermined angular position, outer walls of said front end portion and said base end portion form a stepped outer wall surface, and a pin driving means is provided for driving said restraining pin into and out of said hole.

7. A valve timing adjusting device according to claim 6, wherein said hole is a tapered hole.

8. A valve timing adjusting device according to claim 6, wherein said hole is a straight hole.

9. A valve timing adjusting device according to claim 6, wherein at least one of said front end portion and said base end portion of the restraining pin is tapered.

10. A valve timing adjusting device according to claim 6, wherein at least one of said front end portion and said base end portion of said restraining pin is cylindrically formed.

11. A valve timing adjusting device according to claim 6, wherein depth of insertion of said restraining pin into said hole is limited by abutment of said front end portion thereof against a bottom of said hole.

12. A valve timing adjusting device according to claim 6, wherein an outside diameter of said restraining pin is smaller at the base end portion thereof than at a portion thereof which comes into sliding contact with said pin driving means.

* * * * *